US005106356A

United States Patent [19]

Rhodes et al.

[11] Patent Number: 5,106,356

[45] Date of Patent: Apr. 21, 1992

[54] METHOD AND APPARATUS FOR THE MANUFACTURE OF PAPERBOARD TUBES HAVING CONTROLLED OUTSIDE DIAMETER

[75] Inventors: David E. Rhodes; George E. Lennon; Philip G. Hart, all of Hartsville, S.C.

[73] Assignee: Sonoco Products Company, Hartsville, S.C.

[21] Appl. No.: 707,686

[22] Filed: May 30, 1991

[51] Int. Cl.[5] ..... B31C 1/08

[52] U.S. Cl. ..... 493/8; 493/271; 493/293; 493/301

[58] Field of Search ..... 493/271, 293, 301, 302, 493/8, 16, 25; 156/188, 190, 192, 195, 360

[56] References Cited

U.S. PATENT DOCUMENTS

| | | | |
|---|---|---|---|
| 1,849,111 | 3/1932 | Parker | 493/271 |
| 3,580,146 | 5/1971 | Biancamaria | 493/271 |
| 3,813,026 | 5/1974 | Biancamaria | 493/291 |
| 4,978,406 | 12/1990 | Nakano | 156/192 |

*Primary Examiner*—Bruce M. Kisliuk
*Assistant Examiner*—Jack Lavinder
*Attorney, Agent, or Firm*—Bell, Seltzer, Park & Gibson

[57] ABSTRACT

The invention provides a method and apparatus for the manufacture of helically wound paperboard tubes having a highly uniform outside diameter. The method of the invention involves the application of controlled compressive force to at least one of the paperboard plies fed to a helical winding operation in order to control the thickness of the ply or plies and thereby control the outside diameter of the helically wound tube. In one preferred apparatus embodiment of the invention, the compressive force applied to the paperboard ply is applied via a pair of cooperating compression rolls. The nip between the two cooperating rolls is controllably varied by mounting one of the rolls for rotation about a shaft which is rotatable about an eccentric axis which is parallel to and offset from the axis of rotation of the roll. The rotation of the shaft thus causes the roll to move toward or away from the other cooperating roll and thereby varies the nip spacing between the rolls.

20 Claims, 7 Drawing Sheets

METHOD AND APPARATUS FOR THE MANUFACTURE OF PAPERBOARD TUBES HAVING CONTROLLED OUTSIDE DIAMETER

FIELD OF THE INVENTION

The invention relates to improved paperboard tubes and to a method and apparatus for the manufacture of paperboard tubes having controlled outside dimensions. In addition, the invention relates to an apparatus for the controlled compression of an advancing web, such as a paperboard web, to accurately control its thickness.

BACKGROUND OF THE INVENTION

Multiple ply tubes and particularly multiple ply paperboard or cardboard tubes, are widely used in industry for a variety of purposes. Typically, the multiple layer tubes are made from a plurality of continuous plies which are helically wound about a stationary mandrel. The separate ply strips are fed from separate reels through a glue bath to a stationary mandrel. The plies are then wound helically on the mandrel, one on top of another. An endless belt rotates and advances the formed tube around and along the stationary mandrel. At the downstream end of the mandrel, a severing device cuts the endless tube into separate tubes of a predetermined length.

Helically wound tubes made in this manner have diameters ranging from about 1 inch up to 48 inches or more. These tubes have walls including from 1–2 plies up to 20 plies or greater. Particularly when multiple plies, for example 3 or more plies, are used to form a helically wound tube, the outer diameter of the tube can vary along the tube length.

Variations in the outer diameter of the tube are highly undesirable particularly in some tube applications. When the tubes are used as cores for the high speed winding of textiles, paper, plastic films and the like, a highly uniform and highly controlled outside tube diameter is of significant importance because the winding speed is determined in part by the outer diameter of the tube. In addition, in some film and textile operations, multiple textile and film packages are wound simultaneously on a single mandrel. Unless the outer diameter of the multiple tube cores on the single mandrel are identical, the winding speed will vary from core to core.

Various proposals have been made in the art for improving the uniformity of the outside diameter of paperboard tubes. For example, U.S. Pat. No. 1,849,111 to Parker proposed that a circular series of fingers be provided for pressing inwardly against the outer surface of a tube being wound on a mandrel. The fingers were said to engage the tube over an axial length of a few inches. The tube was said to be fed along so that each successful pinch was a short distance further along the tube. The tube was said to thus be compressed from end to end.

A different proposal for accurately made in U.S. Pat. No. 3,580,146. According to the proposal of this patent, helically wound multi-layer cardboard tubes were said to be wound with one of the layers being a low density material which was substantially compressible in the radial direction. The as-formed tube was externally coated with a thermosetting resin, cut into predetermined lengths and dried. Subsequently, the rough tubes were forcibly inserted through the bore of a heated matrix to reduce the circumference of the tube to a desired precise diameter and cause polymerization of the resin coating.

These proposals for accurately controlling the outside diameter of paperboard tubes result in various difficulties including the interference with the winding operation and/or the need for additional manufacturing steps and apparatus. Such requirements increase the complexity and expense of manufacturing the paperboard tubes. Nevertheless, as winding speeds have increased in textile, film and other manufacturing operations, the need for accurately controlling the outside diameter of paperboard tubes has increased.

SUMMARY OF THE INVENTION

This invention provides improved paperboard tubes and a method and apparatus for the manufacture of helically wound tubes having a highly uniform and predetermined outside diameter. In addition, the invention provides an apparatus for controllably compressing continuous strips or sheets of materials such as paperboard used in the manufacture of helically wound tubes. The method and apparatus of the invention can be used to accurately control the outside diameter of helically wound tubes without requiring substantial modification of the conventional manufacturing process and apparatus. The method and apparatus of the invention are highly variable and can be used to accurately control the outside diameter of helically wound tubes having a wide range of diameters, a wide range of wall thicknesses and containing only a few or numerous bodywall plies. The invention can be practiced without requiring change in materials conventionally used to manufacture paperboard tubes.

The method of the invention is conducted by feeding a plurality of continuous plies of e.g. paperboard or cardboard, in strip form to a mandrel and helically winding the plies about the mandrel to form a continuous tube. At least one parameter indicative of the outside diameter of the tube is sensed and a compressive force based on the sensed parameter is applied to at least one of the continuous strips being fed to the mandrel to control the thickness of the ply. Typically, the application of controlled compressive force to a single ply of paperboard strip can vary the thickness of the individual ply strip by up to 20–30% or more. By carefully controlling the thickness of one or more of the plies being fed to a helical winding operation, it has been found that the outside dimension of the helically wound tubes can be precisely controlled.

The parameter indicative of the outer diameter of the helically wound tube, which is sensed to provide a basis for controlling the thickness of one or more plies being fed to the helical winding operation can be varied according to different embodiments of the invention. In one embodiment the outside diameter of the formed tube can be directly sensed using a light based, sound based or mechanical contact type of diameter sensing apparatus. Signals from the diameter sensing means are passed to a control means which controls the amount of compressive force applied to one or more of the plies being fed to the mandrel. Following an appropriate period of delay sufficient to allow the change in ply thickness to impact the tube diameter, the outside diameter of the tube is again sensed and if necessary the control means sends further instructions for modification of the ply thickness to the compression means.

In other advantageous embodiments of the invention the thickness of one or more of the paperboard plies are measured. Immediately following an adjustment of the compressive force in the compression means, the thickness of the ply treated in the compression means is measured to determine whether the ply thickness has been sufficiently adjusted to correct the sensed variation in the tube outside diameter. If the thickness of the ply has been varied too much or too little, changes in the compressive force applied to the ply can be made to correct the ply thickness by the necessary amount.

Advantageously, the apparatus employed to apply compressive force to the ply includes a pair of cooperating rolls which are mounted for rotation about parallel axes of rotation to thereby define a nip. The nip, or clearance between the rolls, is precisely adjustable. Preferably, one of the rolls is a driven roll and the speed of the drive roll is varied depending on the speed of the endless belt which rotates the helically wound tube on the stationary mandrel. In addition, the speed of the driven roll is advantageously controlled in part in response to a dancer arm sensor located between the rolls and the helical winding operation. This sensor senses a speed differential between the speed of the driven roll of the compressing means and the speed at which the ply is pulled to the helical winding operation.

A particularly preferred apparatus for compressing continuous plies according to the invention includes a means for precisely adjusting the nip between two cooperating rolls which are mounted for rotation about parallel axis for rotation. One of the rolls is mounted on a rotatable shaft which is supported for rotation about an eccentric axis parallel to, and offset from the axis of rotation of the roll. Rotation of the shaft about the eccentric axis causes the roll to move toward or away from the other roll and thereby controls the nip spacing. Advantageously, the rotation of the shaft about the eccentric axis is effected by a pneumatic means such as an air cylinder. When the roll spacing is maintained and adjusted by the pneumatic means, substantial changes in thicknesses of the continuous web can be accommodated. Ply thickness changes can result, for example, when the end of one web is spliced to the beginning of a new web. Thus, a ply including thickness variations resulting from a splice or the like, can pass between the two rolls applying compressive force with ready accommodation of the necessary nip spacing change by the "shock absorbing" capability of the pneumatic means such as an air cylinder.

The invention can be readily applied to existing helical winding operations without substantial modification to the existing apparatus. Thus, a small and unobtrusive means for sensing a desired parameter, such as the thickness of the tube, can readily be added to the helical winding apparatus. A means for compressing one or more of the plies being fed to the helical winding apparatus can readily be accommodated upstream of the helical winding mandrel. Because the method and apparatus of the invention can provide paperboard tubes of uniform outside diameter by controllably compressing the paperboard strips fed to the helical winding operation, the invention does not require change in the chemical or physical makeup of the paperboard plies commonly used to manufacture the tubes.

Paperboard tubes of the invention have a controlled and uniform outside diameter and comprise a plurality of superimposed, helically wound paperboard plies, with at least one of the plies being a compressed ply of decreased thickness and increased density. Advantageously the compressed ply is located as an interior ply in the bodywall, i.e. the compressed ply is not the outside or inside layer of the paperboard tube. This prevents or minimizes the tendency of the ply to gradually return to its original thickness as a result of exposure to ambient humidity or moisture. In one preferred embodiment paperboard tubes of the invention have a controlled and uniform outside diameter and comprise a plurality of superimposed helically wound paperboard plies of substantially identical chemical and physical makeup, i.e. chemical and physical constituents. A portion or all of one of the otherwise identical plies has a reduced thickness and increased density across its width resulting from application of controlled compressive force to the ply, which in turn, provides a uniform outside diameter to the tube.

BRIEF DESCRIPTION OF THE DRAWINGS

In the drawings, which form a portion of the original disclosure of the invention.

DETAILED DESCRIPTION OF THE PREFERRED EMBODIMENT

In the following, a detailed description of a preferred embodiment of the invention is given in which like numbers refer to like parts of the invention. It will be recognized that although specific terms are used in describing the invention, these are used in a descriptive sense only and not for the purposes of limitation. Moreover, it will be apparent that variations and modifications can be made within the spirit and scope of the description without departing from the invention.

Figure 1:
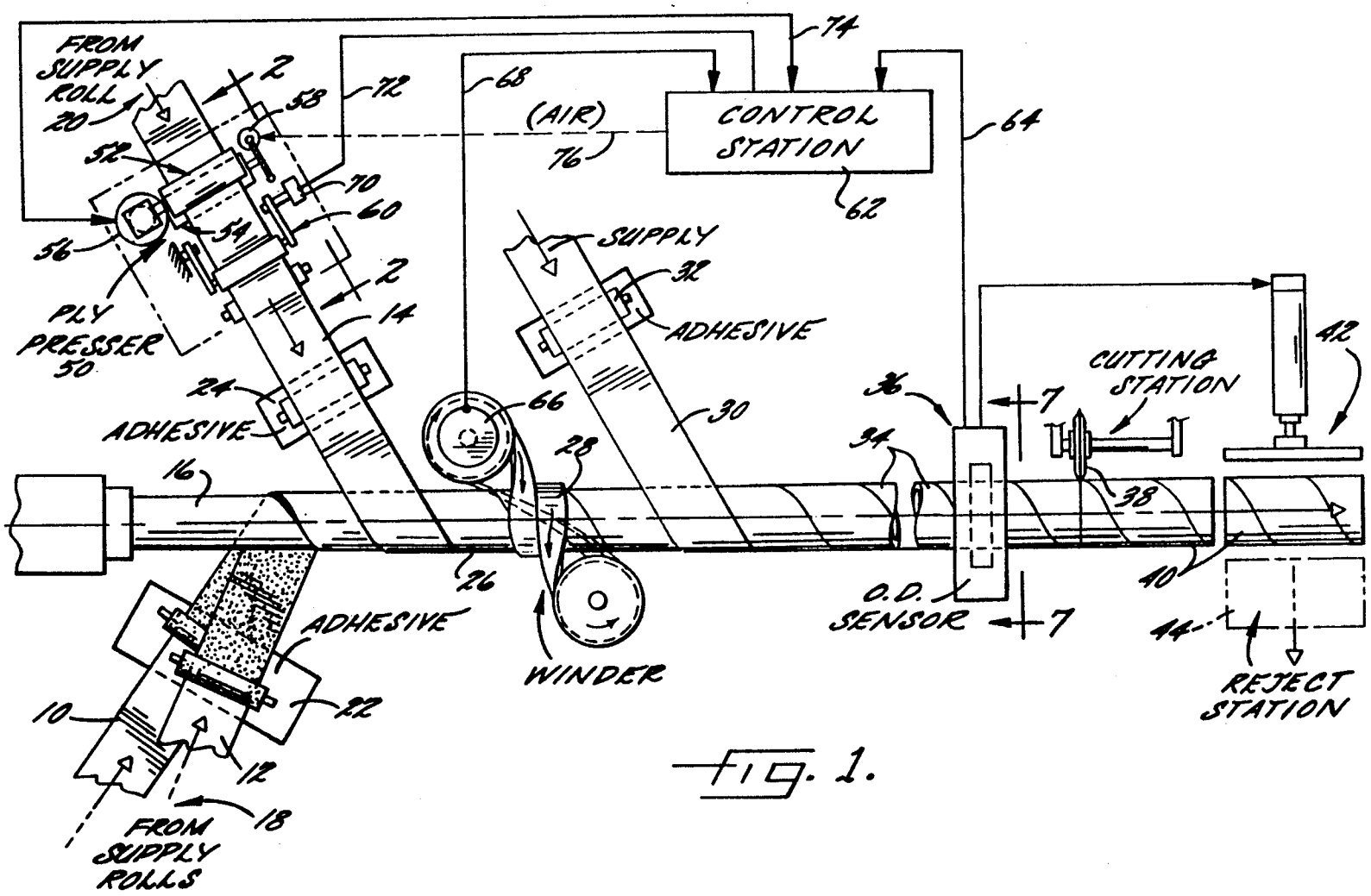
FIG. 1 diagrammatically illustrates one preferred method and apparatus embodiment for manufacturing helically wound tubes having a uniform and precisely controlled outside diameter.

FIG. 1 diagrammatically illustrates a preferred method and apparatus of the invention. A plurality of plies of paperboard in strip form, 10, 12 and 14 are fed in overlapping relationship to a stationary mandrel 16. The continuous plies can be identical or different and are fed from supply rolls or creels as generally indicated at 18 and 20. Prior to contacting stationary mandrel 16, the plies 10, 12 and 14 are fed through adhesive baths 22 and 24 in the conventional manner. The plies are helically wound, one on top of another to form a tube 26 which is advanced to the right along stationary mandrel 16 by endless belt drive 28. A decorative and/or relatively non-porous ply 30 is coated with adhesive on one side via adhesive roll 32 and wound on tube 26 to form a finished endless tube 34.

The finished endless tube 34 is passed through an outside diameter (OD) sensor 36 which senses the outside diameter of the tube via a light, sound, mechanical or similar sensing means. The endless tube is thereafter passed through a cutting station wherein a saw blade 38 cuts the continuous tube into individual tubes 40 of predetermined length.

The outside diameter sensor 36 sends signals to a conventional reject system 42 when the outside diameter of the continuous tube varies more than a predetermined amount. Following a suitable delay period to allow the portion of the tube which is outside of preselected specifications to reach to the reject apparatus 42, any defective individual tubes, indicated in phantom at 44, are removed from the manufacturing line by operation of reject apparatus 42 which may include an automatically acting air cylinder or the like.

The apparatus illustrated in FIG. 1 also includes a ply presser 50 which is shown in greater detail in FIGS. 2–6 and discussed in greater detail hereinafter. Briefly, ply presser 50 applies a controlled compressive force to ply 14 via a pair of compression rolls 52 and 54. One of the rolls, 52 is driven by a motor 56 and the compressive force exerted on the ply 14 passing between the rolls is controlled by a pneumatic cylinder 58, as explained in greater detail later. Following passage through compression rolls 52 and 54, ply 14 passes about a roller mounted at the end of a dancer arm 60, which, as discussed in detail later, senses and compensates for any speed differential between the speed of driven roll 52 and the speed of the ply 14 being pulled onto the mandrel 16 by operation of belt drive 28.

The amount of compression applied to ply 14 and the speed of drive roll 52 are controlled by a control station 62 which receives signals from various means including signals from outside diameter (OD) sensor 36 via line 64; from motor 66 of endless belt drive 28 via line 68 and from a sensor 70 on dancer arm 60 via line 72.

Control station 62 controls the speed of the motor 56 of ply presser 50 via electrical line 74. This in turn controls the speed of the driven roll 52. The control signal sent via line 74 is determined in response to the signals received by the control station from the motor 66 of endless belt drive 28 and from the sensor 70 of dancer arm 60.

In addition, control station 62 sends pressurized air via line 76 to the pneumatic cylinder 58 to control the amount of compression exerted by rolls 52 and 54 on ply 14 as explained later in connection with FIGS. 4–6. The air pressure sent to pneumatic cylinder 58 via line 76 is determined in response to signals received by control station 62 from OD sensor 36. When the signals from OD sensor 36 indicate that the tube diameter is greater than a predetermined amount, the air pressure of line 76 is increased so that pneumatic cylinder 58 causes the two rolls 52 and 54 to exert a greater compressive force on ply 14 and thereby decrease its thickness. Conversely, when the signals received by control station 62 from OD sensor 36 indicate that the tube diameter is less than a predetermined amount, the air sent via line 76 to pneumatic cylinder 58 is adjusted to decrease the force between compression rolls 52 and 54 and thereby increase the thickness of ply 14.

Figure 2:
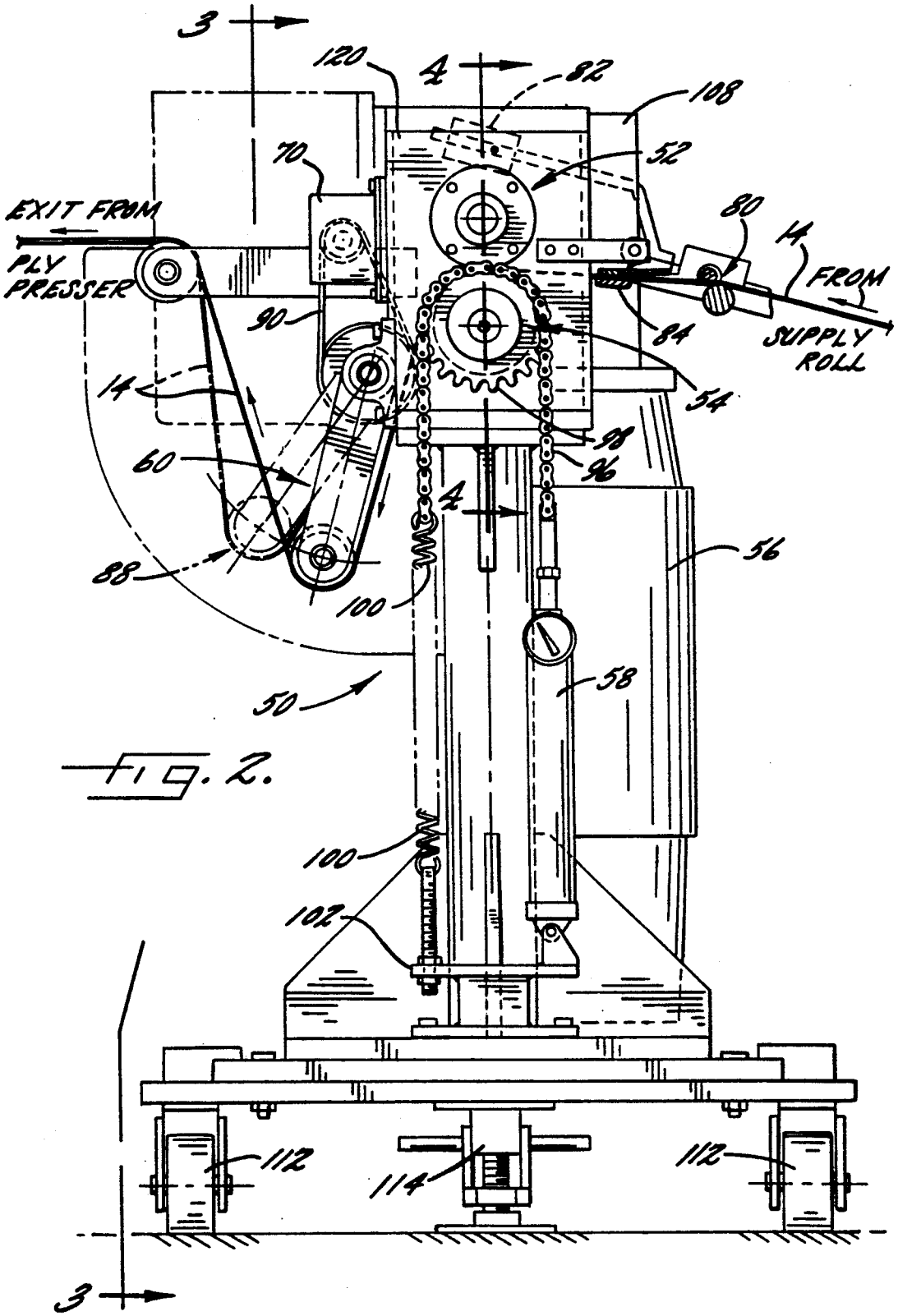
FIG. 2 is a view taken along line 2—2 of FIG. 1 showing a preferred apparatus for compressing continuous paperboard plies and illustrates a paperboard ply being passed through the apparatus.

FIG. 2 is a side view of ply presser 50 taken along line 2—2 of FIG. 1. Ply 14 enters from the right and after passing across a conventional tension system including rolls 80, counterweight 82 and a gripping mechanism 84, the ply passes through the nip of compression rolls 52 and 54. Thereupon the ply 14 passes about the roller at the end of the dancer arm 60, which moves (as indicated generally by phantom view 88 of dancer arm 60) in response to changes in tension on ply 14 resulting from changes in the rate at which the ply 14 is pulled by the mandrel.

Movement of dancer arm 60 from one position to another, for example to the position indicated at 88, also results in rotation of a belt 90 which is connected to a potentiometer or like sensor 70. Thus, sensor 70 detects any motion of dancer arm 60, which in turn, is indicative of a speed differential between the rate the ply is being pulled to the mandrel and the rate the ply is being fed through the compression rolls 52 and 54.

Air cylinder 58 of FIG. 2 is operatively connected to a chain drive 96 which is attached to a sprocket wheel 98. Chain drive 96 is connected at its other end to a spring 100 which is mounted on a portion 102 of the frame of the ply pressing apparatus. When the air pressure fed to air cylinder 58 is changed, the chain drive 96 in turn moves upwardly or downwardly thereby rotating sprocket wheel 98. As explained later in connection with FIGS. 4–6, rotation of sprocket wheel 98 adjusts the position of compression roll 54 upwardly or downwardly.

Figure 3:
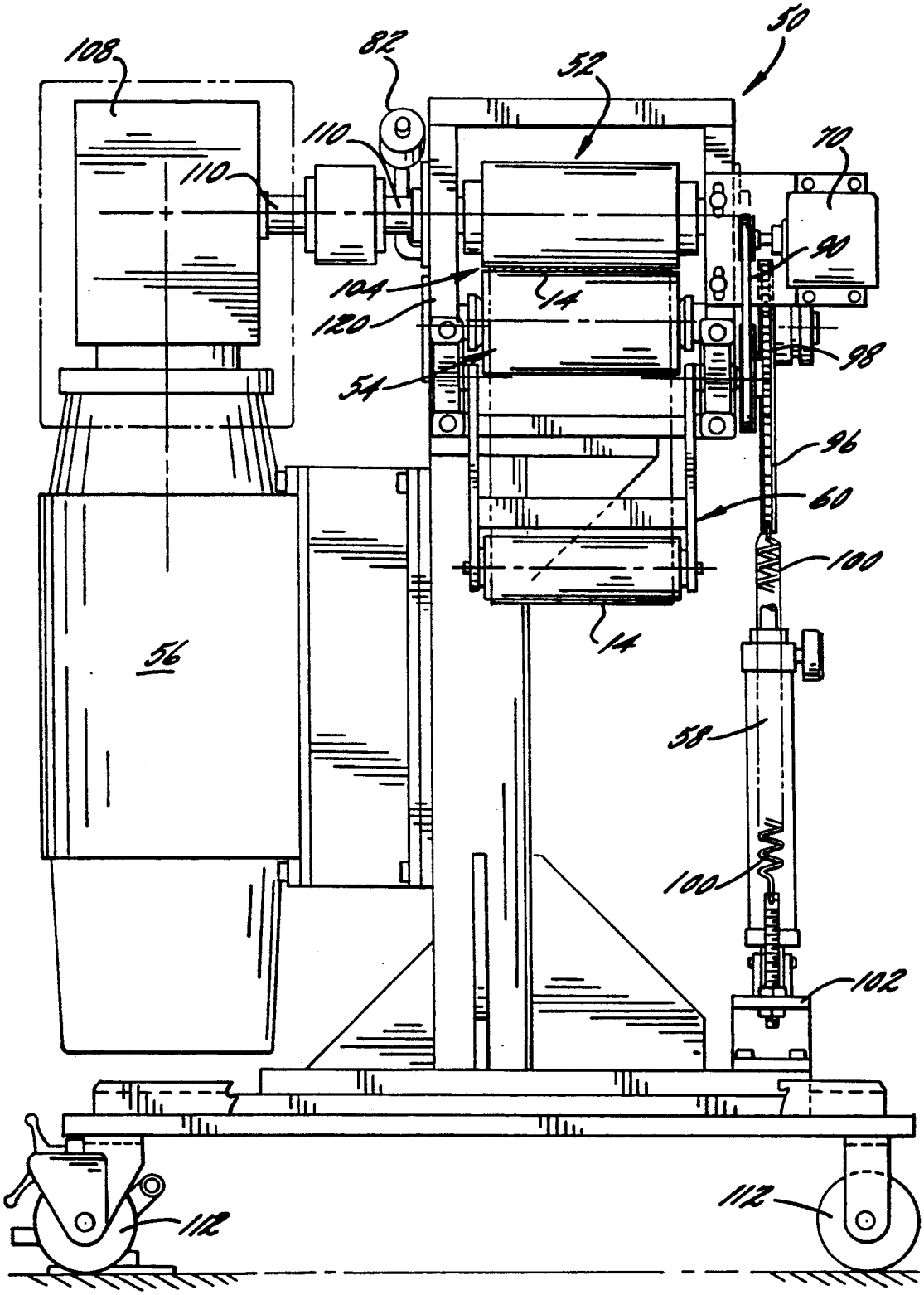
FIG. 3 is a front view of the apparatus of FIG. 2 taken along line 3—3 thereof.

FIG. 3 illustrates a front view of the apparatus of FIG. 2. The ply 14 can be seen moving through the nip 104 between rolls 52 and 54. Additionally shown in FIG. 3 is the motor drive 56 which is connected via a transmission 108 and drive shafts 110 to driven roll 52. The entire ply presser apparatus 50 may be mounted on wheels 112 as shown in FIGS. 2 and 3 so that it can be moved as desired. An anchoring mechanism 114 is provided for temporarily anchoring the apparatus in a desired location.

Figure 4:
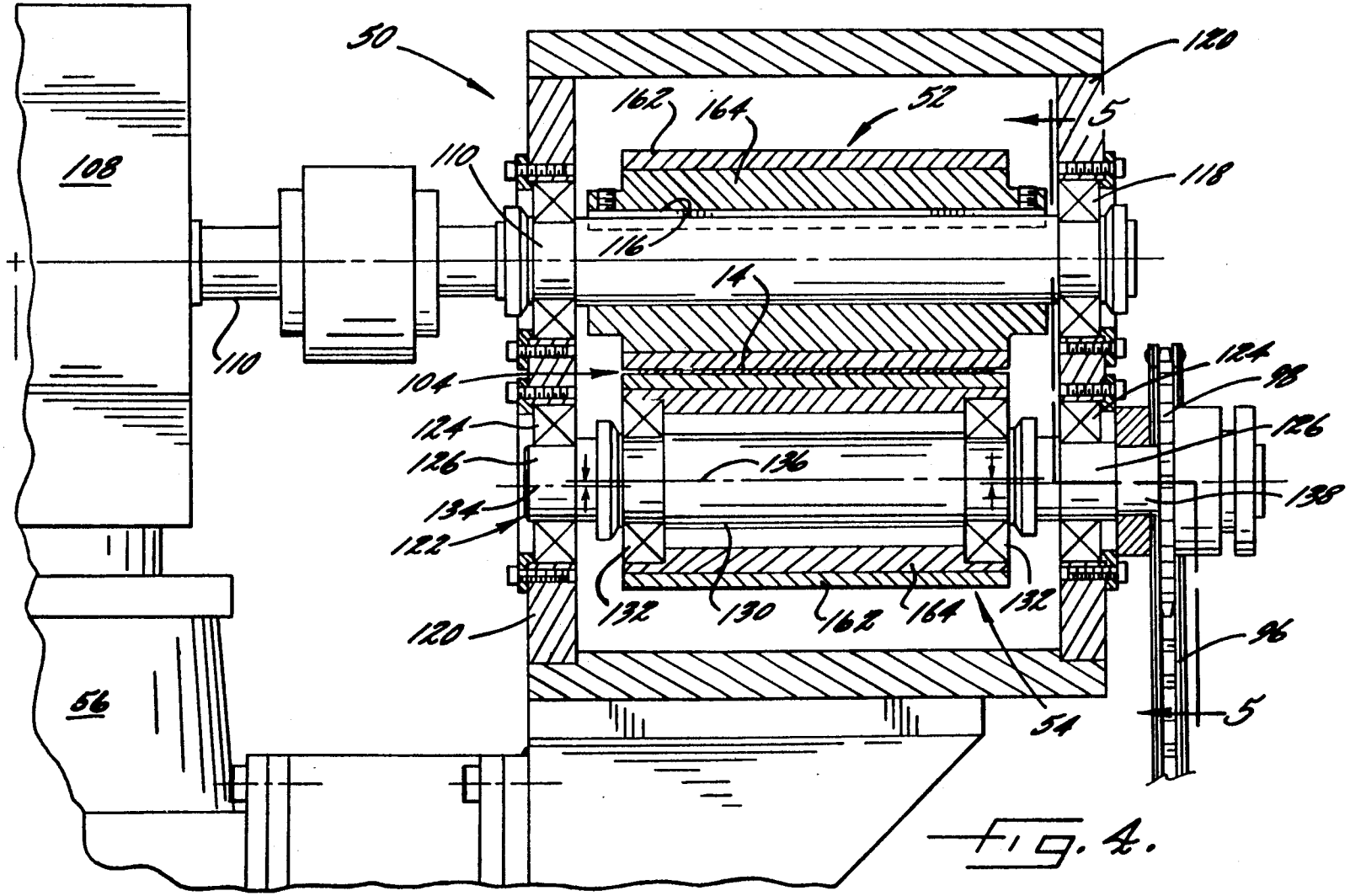
FIG. 4 is an enlarged partial cross-sectional view of the apparatus of FIG. 2 taken along FIG. 4—4 thereof and illustrates the construction and arrangement of the compression rolls.

The structure and mounting of compression rolls 52 and 54 is best seen in FIG. 4. Driven roll 52 is coaxially and fixedly attached by a conventional locking key 116 to drive shaft 110. The drive shaft is supported by bearings 118 within frame 120 of the ply pressing apparatus.

The lower compression roll 54 is supported via an eccentric shaft 122 and a set of bearings 124 in frame 120 of the apparatus. The eccentric shaft 122 is made up of two coaxial stub shaft or end portions 126 which are eccentrically positioned on the two ends of a center shaft portion 130. Advantageously, the eccentric shaft 122 is a one piece shaft and thus stub shafts 126 are integrally formed with center shaft 130 by conventional metal lathe operations. Roll 54 is supported for rotation about shaft 130 on bearings 132, which are preferably spherical bearings. The axes of stub shafts 126 are offset from the axis of center shaft 130, by a small offset amount as seen by the difference between center line 134 of stub shaft 126 and center line 136 of center shaft 130. Sprocket wheel 98 is coaxially attached to one of the stub shafts 126 via a connecting shaft 138.

Figure 5:
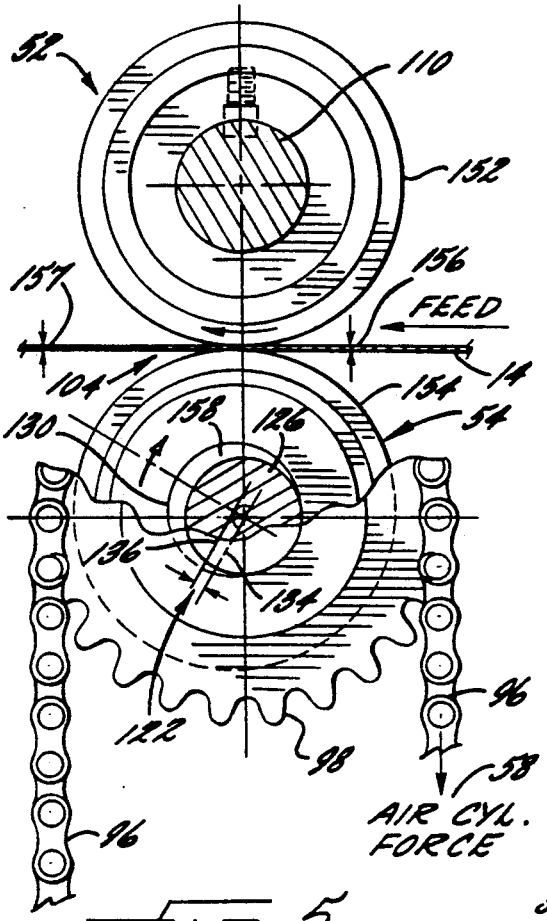
FIGS. 5 and 6 are partial cross-sectional views taken along 5—5 of FIG. 4 and illustrate the means for adjusting the nip spacing between the two compression rolls.
Figure 6:
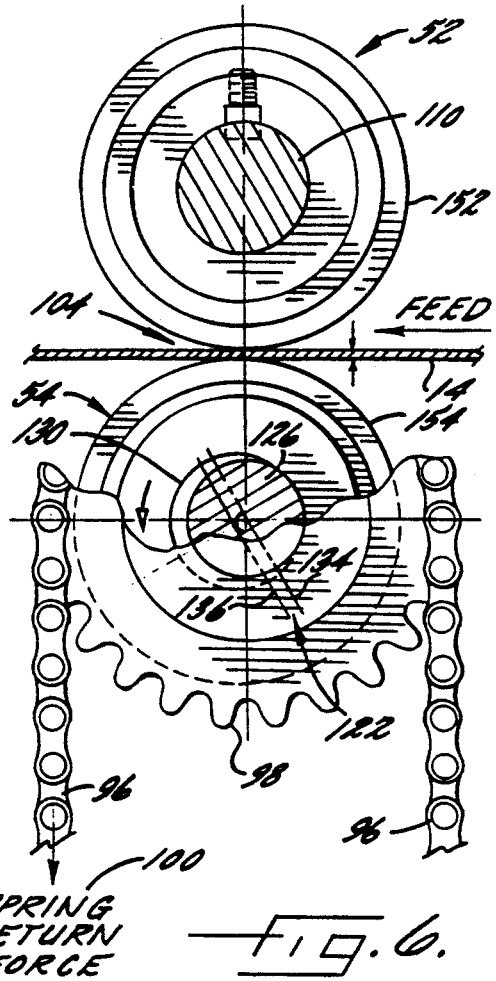

The rotation of eccentric shaft 122, and its effect in changing the spacing of the nip between the rolls 52 and 54, are best shown in FIGS. 5 and 6. FIG. 5 illustrates the application of downward force by the air cylinder causing chain drive 96 to rotate sprocket 98 in the clockwise direction. This in turn moves the axis 136 of center shaft 130 closer to upper roll 52. Because the center shaft 130 defines the axis of rotation of lower roll 54, the peripheral surfaces 152 and 154 of rolls 52 and 54, respectively, are moved closer together. The clearance or nip 104 between the rolls is thereby decreased. Accordingly, the thickness of ply 14 on the upstream side of rolls, as indicated at location 156, is greater than the thickness of ply 14 on the downstream side of the rolls, as indicated at location 157. The rotation of sprocket 98 in the counterclockwise direction is illustrated in FIG. 6. In this case, the force applied by the air cylinder is relaxed and the return force exerted by the spring 100 on chain drive 96 causes sprocket 98 to rotate in the counterclockwise direction. This in turn moves the axis of rotation 136 of lower roller 54 away from the axis of drive shaft 110 of upper roller 52. Nip 104 is thereby increased sufficiently that ply 14 is not compressed as it passes between drive rolls 52 and 54.

The offset between the center of stub shaft 126 and the center of central shaft 130 will depend on the diameters of the two shafts and on the outside diameter of the lower drive roll 54. An offset of 0.07 inches has been found to be particularly desirable with a stub shaft diameter of 1.77 inches, a center shaft diameter (at the bearing support surfaces) of 1.97 inches and an outer roll diameter of 4.5 inches. Additionally, it is desirable that the offset portion of the eccentric shaft as indicated by the crescent portion 158 of FIG. 5, be positioned so that it cannot be rotated fully upwardly without causing contact between the two pressure rollers 52 and 54. This avoids the problem that the eccentric shaft can be rotated past the point which brings the axes of rotation of the upper and lower rolls at their closest location.

As best seen in FIG. 4, rolls 52 and 54 are preferably formed from an outer sleeve section 162 and a co-axial inner section 164. Advantageously, the interior annular section 164 is formed of a conventional cold roll steel while the exterior sleeve portion 162 is made of a heat treated hardened steel, advantageously having a Rockwell Hardness of Rc 58-60. The exterior hardened sleeve can be attached to the inner roll annulus by heating to expand the exterior sleeve and then shrink fitting the heated exterior sleeve onto the cool interior annulus.

The ply presser illustrated in FIGS. 2-6 is typically capable of applying from 1,000 to 1,500 pounds, per inch width, of paperboard fed between the compression rolls. At such pressures, the plies which typically have thicknesses of from about 0.020 to 0.035 inches can be compressed in an amount of from about 20 to 30 percent and greater. It will be recognized that paperboard plies are available in a wide range of densities and in a wide range of thicknesses and that the amount of change of thickness can be widely varied, depending on the particular construction of the paperboard ply.

It will be apparent that the means for applying compressive force between the two compression rolls previously described provides a significant amount "shock absorbing" capacity, both because of the air cylinder and because of the spring. The skilled artisan will recognize that continuous paperboard plies are supplied from large rolls or creels and that the end of the ply on one roll is often spliced to the beginning of a ply on another roll so that the tube winding operation is not stopped when a ply roll is exhausted. In such instances, the thickness of the ply at the location of the splice will be substantially greater than the remaining thickness of the ply. By employing the pneumatic tensioning means, particularly in combination with the spring tensioning means, the spacing between the rolls, i.e., the nip, can automatically accommodate passage of such splices or the like.

Figure 7:
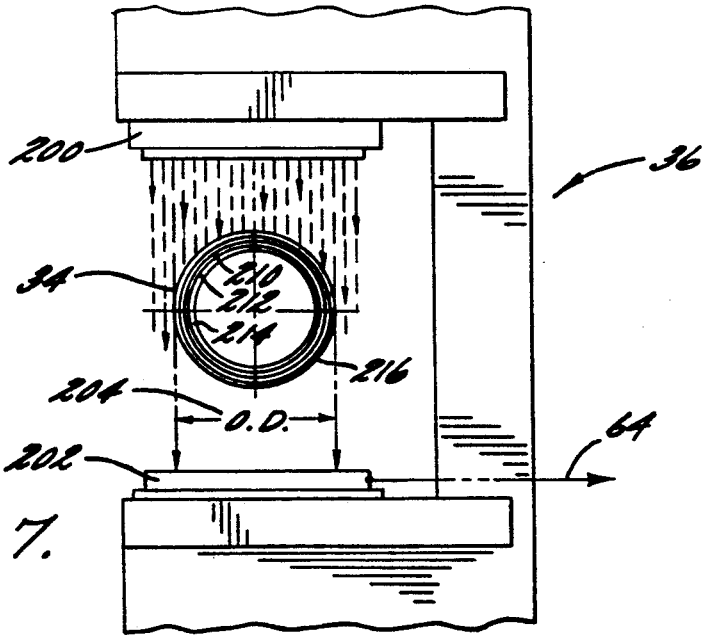
FIG. 7 is an enlarged partial cross-sectional view taken along line 7—7 of FIG. 1 and illustrates a preferred device for sensing the outside diameter of helically wound tubes made in accordance with the invention.

FIG. 7 illustrates a preferred apparatus for sensing the outside diameter for the multiple ply spirally wound tube. A source of radiant illumination 200, emits a linear beam of radiant illumination having a predetermined width greater than the outside diameter of the tube 34. The radiant illumination can be laser illumination i.e., coherent light, or the like and is located on one side of the continuous tube. A receiver 202 is located directly beneath the radiant source on the opposite side of the tube. A portion of the light emitted by the source 200 is absorbed or deflected by the multiple ply tube 34. The area 204 of the light source which is blocked by the presence of the tube is thus the same as, or proportional to, the outside diameter of the tube 34. The width of area 204 is calculated or measured to provide a signal 64. Signal 64, which is indicative of the outside diameter of tube 34, is supplied to the control station 62 (FIG. 1). The single laser beam which is wider than the tube diameter, as illustrated in FIG. 7, can be replaced with two laser sources, located near the edges of the tube so that only the longitudinal sides of the tube, and not the center of the tube, is illuminated by the source 200.

Figure 8:
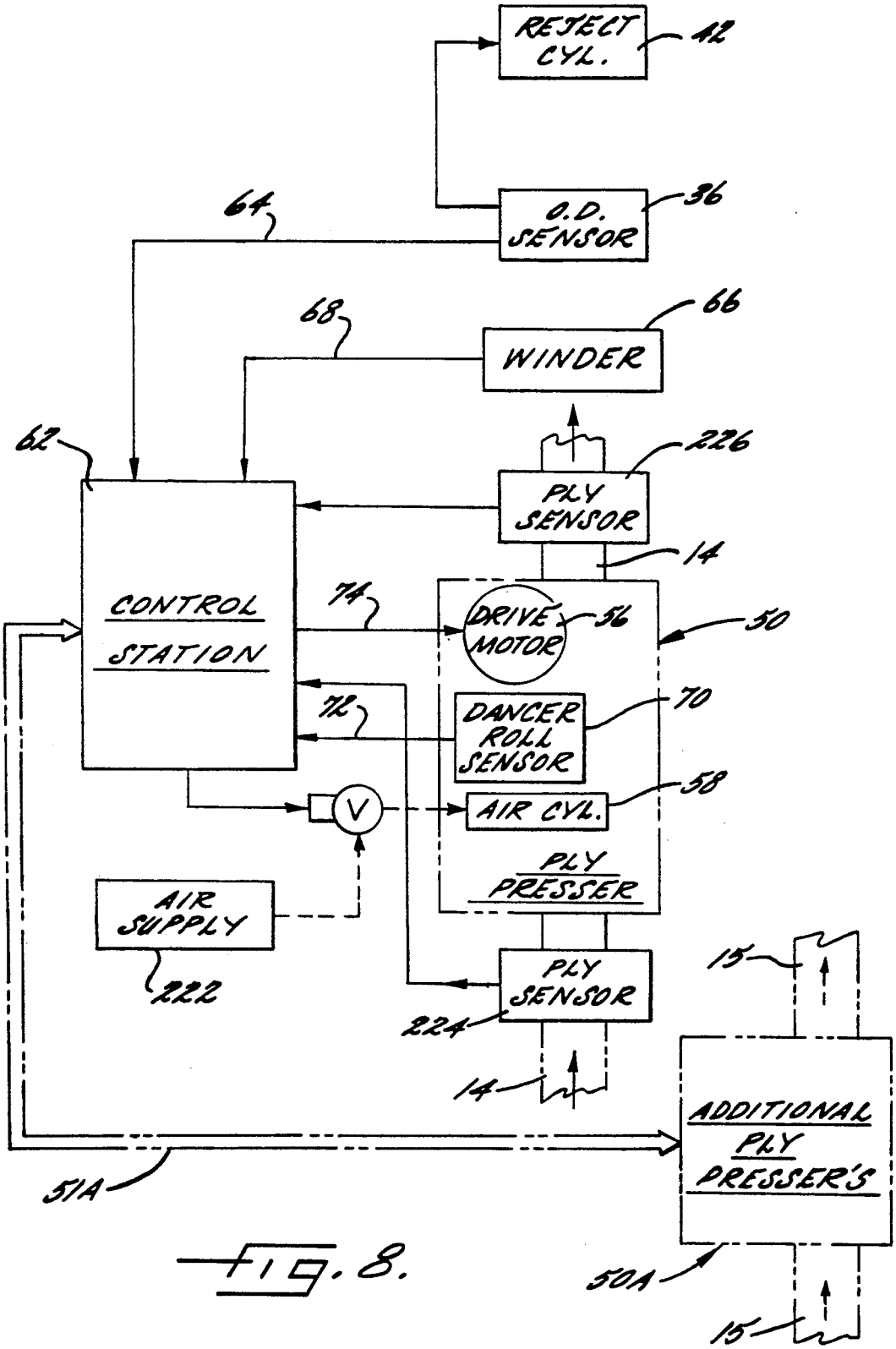
FIG. 8 diagrammatically illustrates a preferred control system of the invention.

FIG. 8 illustrates a preferred control system of the invention. The speed and compression force applied to the ply 14 in the ply presser 50 are controlled by a control station 62. The control station can be any of the commercially available programmable logic controllers as known to the skilled artisan.

The speed of the drive motor 56 of the ply presser 50 is controlled in response to signals from the winder motor 66 which governs the speed of drive belt 28 (FIG. 1) which in turn moves the helically wound tube along the stationary mandrel. Returning to FIG. 8, the speed of drive motor 56 is also determined in response to the position of the dancer arm 60 (FIG. 2) as sensed by sensor 70 (FIG. 2). The signal from the winder motor and the dancer roll sensor are advantageously combined electrically by a signal isolation card or a similar summing means to provide a control signal 74 for the drive motor 56 of ply presser 50. Control signal 74 advantageously is determined based primarily on the speed of winder motor 66 and to a smaller degree on the signal from dancer roll sensor 70. For example, the signal sent to drive motor 56 can be based on an amount of about 70 percent of the speed of winder motor 66 and in an amount of about 30 percent based on the signal from dancer roll sensor 70.

Control station 62 also controls operation of a programmable air regulating valve 220 which in turn determines the air pressure sent via air line 76 to air cylinder 58. The air regulating valve 220 receives a supply of pressurized air from an air supply 222. The programmable air regulating valve 220 can be of any known type or design. One preferred air regulating valve is a programmable air regulating three-way valve available from Schrader Bellows Company. This valve is connected to a source of high pressure air and a source of low pressure air and is capable of dividing the range of air pressures, between the low pressure and high pressure, into 16 incremental pressure values. It will be apparent that programmable valves capable of providing a greater or smaller number of discrete air pressures, or a continuously variable air valve can also advantageously be used in the system of FIG. 8.

The signals sent by control station 62 to programmable air valve 220 are determined based on signals from OD sensor 36. Thus, control station 62 includes a set of instructions including a predetermined outside diameter value or range of outside diameter values. The outside diameter values, as determined by OD sensor 36, are compared in the control station to the predetermined value or range of values. When the value as determined by OD sensor 36 is different from the predetermined value or range of values, control station 62 sends instructions to valve 220 for an appropriate upward or downward adjustment of pressure.

The system shown in FIG. 8 also includes optional ply sensors 224 and 226 upstream of, and downstream of ply presser 50, respectively. The optional sensors 224 and 226 are sensors for determining the thickness of the ply 14 as it enters and as it leaves the ply presser 50 and can be mechanical, light or sound based sensors or the like. Ply sensor 226 which is downstream of the presser 50. is capable of making rapid measurements indicative of whether the adjustments to the compression rolls have changed ply thickness appropriately. Ply sensor 224 which is upstream of the presser 50 can be used to sense to the approach of ply portions of unusually large or unusually small thickness so that appropriate adjustments in the compression force between the rolls can be made.

The system shown in FIG. 8 also includes one or more additional ply pressers, 50A which vary the thickness of one or more additional plies 15 being fed to a helical winding operation. The additional ply pressers 50A include the various sensors and parts specifically shown with respect to ply presser 50. Control station communicates with the additional ply pressers 50A via line 51A which includes the various lines shown with respect to the communications between control station 62 and ply presser 50. Each of the plural ply pressers, 50, 50A, etc., advantageously has an independent speed control system responsive to signals from the winder motor 66 and from the dancer arm on the individual ply presser unit 50, 50A, etc.

As shown in FIG. 8, the reject cylinder 42 can receive signals directly from OD sensor 36. It will be apparent that the reject station 42 can optionally be controlled by control station 62 although this is not specifically shown in FIG. 8.

Figure 9:
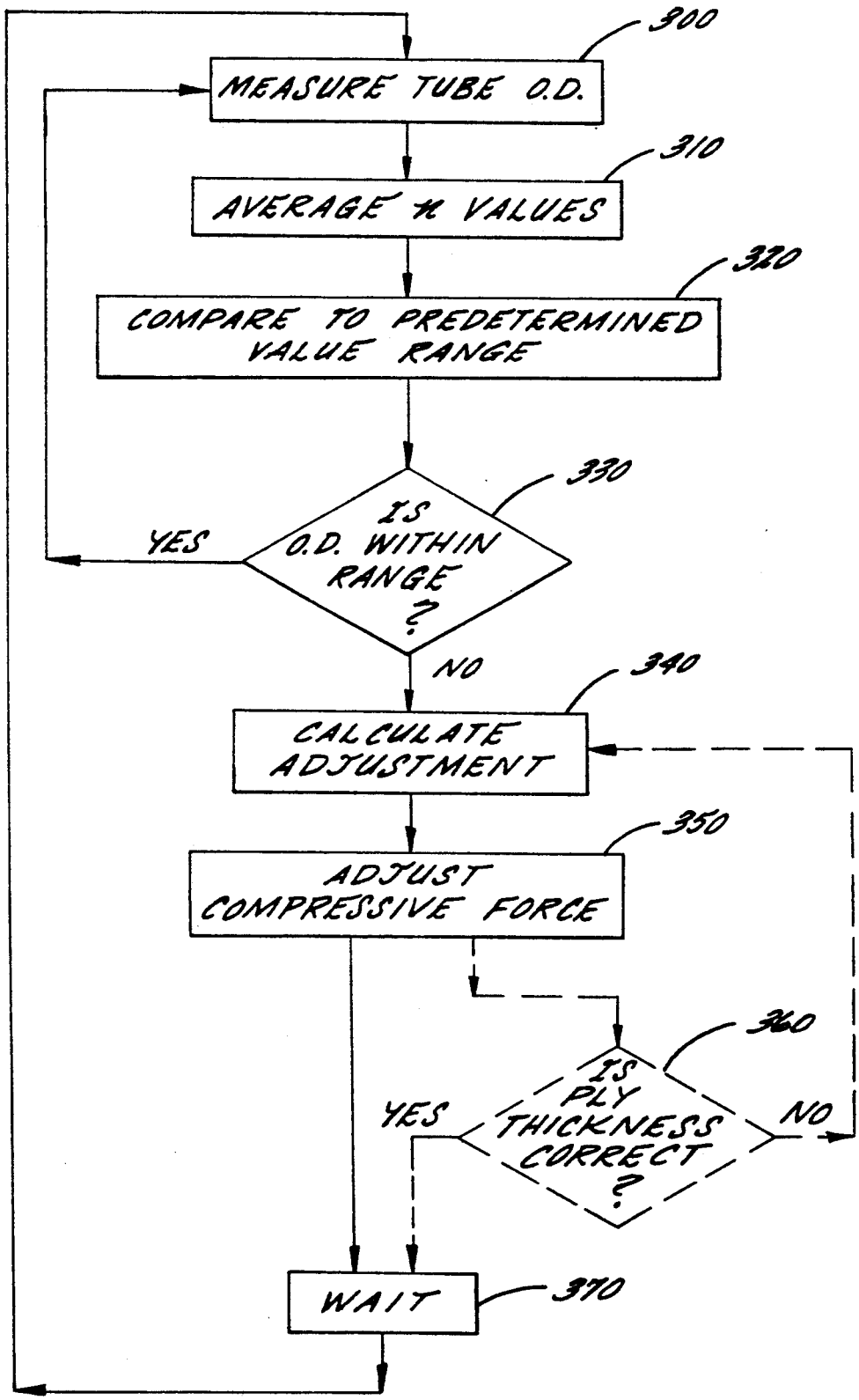
FIG. 9 illustrates one preferred control method of the invention.

FIG. 9 illustrates one preferred control embodiment for operation of the method and apparatus of the invention. With reference to FIG. 9, in block 300 the outside diameter of the continuous tube is measured. Control is then passed to block 310 wherein a number of discrete values of tube diameter are averaged to determine an average OD value. Control is next passed to block 320 wherein the average value determined in block 310 is compared to a predetermined value or range of OD values. The predetermined value range is set by the manufacturer of the tube depending on the desired specifications. Control is passed from block 320 to block 330.

From block 330, control is returned to block 300 if the average outside tube diameter value is within the predetermined range. If the average value is not within the predetermined range, then control passes to block 340. In block 340 the adjustment necessary for one or a plurality of plies is determined based on the difference between the measured OD diameter and the set point OD diameter. For example, if the measured OD value is substantially outside of the set point range then block 340 will calculate a substantial adjustment. Conversely, if the measured value is only slightly outside of the predetermined range then only a small adjustment is calculated in block 340.

Control is then passed to block 350 wherein signals are generated and passed to the operative hardware for adjusting the compressive force being exerted on one or more plies in response to the adjustment calculated in block 340.

If there is a ply thickness sensor 226 (FIG. 8) immediately downstream of the ply presser 50, control is then passed to optional block 360 wherein the ply thickness, measured downstream of the ply presser 50, is examined to determined if an appropriate adjustment has been made. If the appropriate adjustment has not been made to the single ply, control returns to block 340 for calculation of a further adjustment to the ply thickness. If the appropriate adjustment has been made to the ply thickness, control then passes to block 370. If the system does not include a ply thickness sensor immediately downstream from the ply presser 50, control is passed directly from block 350 to block 370.

In block 370 an appropriate waiting period is determined, i.e., calculated to allow the portion of ply 14 having an adjusted thickness, to move from the ply presser 50 (FIG. 1) to mandrel 16, and for the adjusted thickness portion of the ply to be incorporated into the continuous tube 34 and arrive at OD sensor 36. Because control station 62 receives signals from winder motor 66, the period of delay calculated in block 370 can be continuously adjusted upwardly or downwardly depending on the speed of winder motor 66 to determine precisely when the portion of the ply having adjusted thickness will arrive at OD sensor 36 even though the speed of the winder may vary.

Following the appropriate waiting period, control of the system is then returned to block 300 wherein the outside diameter of the continuous tube is once again measured and the control sequence is repeated.

It will be apparent that the invention is susceptible to numerous changes. For example, the control sequence described above can be modified for use with different types of paperboard plies having different thicknesses and/or different densities. In such an instance, the values sent to adjust the compressive force will be varied based on the density of the paperboard ply. It is also contemplated that the OD sensor can be replaced or supplemented with ply thickness sensors upstream of the mandrel so that the tube OD can be determined based on the combined thicknesses of the plies fed to the mandrel. The ply presser apparatus described in detail previously can be modified to incorporate a different means for controlling the nip spacing, as for example, an electrically adjustable device for adjusting the rolls relative to each other. Moreover, the ply pressing device can be adapted to compress a plurality of plies and/or can include additional compression rolls.

When using only a single ply presser the method and apparatus of the invention is capable of maintaining the outside diameter of multi-ply paperboard tubes having an outside diameter of between about 1 and about 20 inches to a uniformity of less than or equal to plus or minus 0.015 inch or better, preferably to within a uniformity of less than or equal to plus or minus 0.010 inch or better. It will be apparent that the OD tolerance will be impacted by the total number of plies in the bodywall. It will also be apparent that the invention is applicable to tubes of diameters up to and exceeding 40–50 inches and including any number of bodywall plies.

As best seen in FIG. 7, the multiple ply helically wound tubes of the invention include a plurality of layers, 210, 212, 214, etc. At least one of the layers will be a compressed paperboard ply. Advantageously, the compressed ply will be an interior bodywall ply so that the ply is not exposed to ambient humidity or moisture. In some instances, the compressed ply layer can have different thicknesses at different locations along the tube length, as for example when a tube includes a ply portion that was passing through the ply presser 50 during a time period when the compression was changed. In such instances, the compressed ply will have one thickness at one tube end and a different thickness at the other tube end. Because the helical winding operation of the invention does not require changes in the construction of the paperboard strips fed to the helical winding operation, the tube can in a particularly preferred embodiment of the invention include a plurality of superimposed plies which are substantially identical in chemical and physical makeup, except that one or more of the otherwise identical plies have increased density and reduced thickness. Thus, the fiber type and fiber length of the material making up the plurality of plies can be the same, as can be the chemical additives present in the plies and/or the chemical nature of the individual fibers. Typically there can be at least three plies of substantially identical chemical and physical make-up. It will be recognized that the exterior ply layer 216 will typically be different from the remaining plies.

The invention has been described in considerable detail with reference to its preferred embodiments. It will be apparent that numerous variations and modifications can be made within the spirit and scope of the invention as described in the foregoing detailed specification and as defined in the following claims.

That which is claimed is:

1. A method for the manufacture of helically wound tubes having a highly uniform and predetermined outside diameter comprising the steps:

feeding a plurality of continuous paperboard plies in strip form to a stationary mandrel;

helically winding the plurality of plies about the stationary mandrel in superimposed relationship to form a continuous helically wound paperboard tube;

sensing at least one parameter indicative of the outside diameter of the continuous helically wound tube; and applying a controlled compressive force to at least one of the continuous paperboard plies being fed to the stationary mandrel in response to the sensed parameter to thereby control the thickness of the continuous paperboard ply and the outside diameter of the continuous helically wound tube.

2. The method of claim 1 wherein the step of sensing at least one parameter indicative of the outside diameter of the tube is accomplished by directly sensing the outside diameter of the continuous tube.

3. The method of claim 1 wherein the step of sensing at least one parameter indicative of the outside diameter of the continuous tube includes sensing the thickness of at least one of the continuous paperboard plies being fed to the mandrel.

4. The method of claim 1 wherein the step of sensing at least one parameter indicative of the outside diameter of the continuous tube includes directly sensing the diameter of the continuous tube, and sensing the thickness of at least one continuous paperboard ply being fed to the stationary mandrel.

5. The method of claim 1 wherein at least two continuous paperboard plies being fed to the mandrel are treated by applying compressive force thereto in an amount based on the sensed parameter.

6. The method of claim 1 additionally comprising the steps of; dividing the continuous tube into a plurality of discrete tubes of predetermined length; and rejecting selected ones of the plurality of discrete tubes of predetermined length in response to the sensed parameter indicative of the outside diameter of the continuous tube being outside a predetermined range.

7. The method of claim 1 wherein the step of applying compressive force to at least one continuous paperboard ply includes feeding said continuous ply in strip form through the nip of two compression rolls; and varying the spacing of the nip between the rolls in response to the parameter indicative of the outside diameter of the continuous tube.

8. The method of claim 7 wherein at least one of the compression rolls is positively driven at a predetermined speed.

9. The method of claim 8 including the step of sensing the rate at which said plurality of continuous plies in strip form are helically wound around the stationary mandrel; and varying the speed of the positively driven compression roll in response to the sensed rate of winding so as to maintain the tension of the ply within a predetermined range.

10. The method of claim 1 further comprising the steps following said step of applying compressive force to said continuous ply of: determining a delay period of sufficient time to allow outside diameter of the continuous helically wound tube to change in response to the step of applying compressive force to the continuous ply; sensing the outside diameter of the continuous helically wound tube at a time following said delay period; and adjusting the compressive force applied to said continuous ply in an amount based on the sensed outside diameter of the continuous helically wound tube.

11. An apparatus for the manufacture of a paperboard tube having a highly uniform and predetermined outside diameter comprising:

a stationary cylindrical mandrel;

means for feeding a plurality of continuous paperboard plies in strip form to the mandrel;

means for helically winding the continuous paperboard plies about the mandrel in superimposed relationship to form a continuous, multiple ply, helically wound, paperboard tube;

means for sensing at least one parameter indicative of the outside diameter of the continuous, multiple ply, helically wound paperboard tube; and means for applying compressive force to at least one continuous ply being fed to the mandrel to thereby control the thickness of the continuous ply in response to the sensed parameter.

12. The apparatus of claim 11 wherein said means for applying compressive force to said continuous ply comprises a pair of cooperating rolls mounted for rotation about parallel axes so as to define a nip therebetween; and means for adjusting the nip between the rolls in response to the sensed parameter indicative of the outside diameter of the continuous helically wound tube.

13. The method of claim 12 wherein the means for adjusting the nip between the two rolls comprises a pneumatic means operatively associated with a mounting means for at least one of the rolls.

14. The apparatus of claim 13, further comprising a programmable valve means for supplying air of predetermined pressure to said pneumatic means; and control means for controlling said programmable valve, said control means being connected to said means for sensing said parameter indicative of the outside diameter of said continuous tube and being programmed to control said programmable valve in response to said sensing means.

15. The apparatus of claim 12 additionally comprising; a drive means for driving at least one of said rolls; winder means for driving the means for winding the plurality of continuous plies about the mandrel; sensing means for sensing the speed of the winder drive means; and control means for controlling the speed of said roll drive means in response to the speed of said winder drive means.

16. The apparatus of claim 11 wherein the means for sensing a parameter indicative of the outside diameter of said continuous helically wound paperboard tube comprises an emitting means for emitting a beam of radiant illumination having a predetermined width greater than the outside diameter of the continuots helically wound tube; and a receiving means for receiving at least a portion of the light emitted by the emitter means, the emitter means and receiving means being positioned on opposite sides of the continuous helically wound paperboard tube.

17. The apparatus of claim 16 wherein said emitter means emits a beam of coherent radiant illumination having a predetermined width greater than the outside diameter of the continuous helically wound tube.

18. The apparatus of claim 16 additionally comprising a thickness sensing means positioned downstream of the means for applying compressive force to at least one continuous paperboard ply, said thickness sensing means being arranged to sense the thickness of said at least one ply treated in the compressive force applying means.

19. The apparatus of claim 11 comprising at least one means for applying compressive force to at least a second of the plurality of continuous paperboard plies in strip form being fed to the mandrel to vary the thickness of the second continuous paperboard ply in response to the sensed parameter indicative of the outside diameter of the continuous helically wound paperboard tube.

20. The apparatus of claim 11 additionally comprising:

a means for severing the continuous tube into a plurality of tubes of predetermined lengths; and means for rejecting selected ones of said plurality of tubes of predetermined length.

* * * * *

UNITED STATES PATENT AND TRADEMARK OFFICE

CERTIFICATE OF CORRECTION

PATENT NO. : 5,106,356

DATED : April 21, 1992

INVENTOR(S) : David E. Rhodes, et al.

It is certified that error appears in the above-identified patent and that said Letters Patent is hereby corrected as shown below:

Column 1, line 59, after "accurately" insert -- controlling the outer dimensions of cardboard tubes was --.

IN THE CLAIMS:

Column 13, line 16, after "winder" insert -- drive --.

Signed and Sealed this

Twenty-second Day of June, 1993

*Attest:*

Michael K. Kirk

MICHAEL K. KIRK

*Attesting Officer*

*Acting Commissioner of Patents and Trademarks*